US007716956B2

(12) United States Patent
Aouad et al.

(10) Patent No.: US 7,716,956 B2
(45) Date of Patent: May 18, 2010

(54) ATTACHMENT MEANS

(75) Inventors: Yousef Georges Aouad, Cincinnati, OH (US); Arthur Hampton Neergaard, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 785 days.

(21) Appl. No.: 10/737,429

(22) Filed: Dec. 16, 2003

(65) Prior Publication Data

US 2004/0172768 A1 Sep. 9, 2004

Related U.S. Application Data

(60) Provisional application No. 60/435,646, filed on Dec. 20, 2002.

(51) Int. Cl.
*D06F 35/00* (2006.01)

(52) U.S. Cl. ..... 68/12.18; 68/12.01; 68/17 R

(58) Field of Classification Search ..... 248/223.41, 248/224.51, 224.61; 68/12.01, 12.18, 17 R
See application file for complete search history.

(56) References Cited

U.S. PATENT DOCUMENTS

| | | | | |
|---|---|---|---|---|
| 3,895,775 | A * | 7/1975 | Norton | 248/476 |
| 3,988,908 | A | 11/1976 | Beare et al. | |
| 4,026,131 | A | 5/1977 | Dugger et al. | |
| 4,154,421 | A * | 5/1979 | Suvitie | 248/327 |
| 4,186,573 | A | 2/1980 | Brenner et al. | |
| 4,260,054 | A | 4/1981 | Bory et al. | |
| 4,265,372 | A | 5/1981 | Wainberg | |
| 4,379,515 | A | 4/1983 | Towsend | |
| 4,416,791 | A | 11/1983 | Haq | |
| 4,429,812 | A | 2/1984 | Steiner et al. | |
| 4,588,080 | A | 5/1986 | Ginn | |
| 4,700,857 | A | 10/1987 | Kittscher et al. | |
| 4,882,917 | A | 11/1989 | Mizusawa et al. | |
| 4,982,467 | A | 1/1991 | Mizusawa et al. | |
| 5,033,643 | A | 7/1991 | Schumacher | |
| 5,061,807 | A | 10/1991 | Gethöffer et al. | |
| 5,109,992 | A * | 5/1992 | Miller | 211/59.1 |
| 5,129,120 | A | 7/1992 | Cornette et al. | |
| 5,133,487 | A | 7/1992 | Russi | |

(Continued)

FOREIGN PATENT DOCUMENTS

| | | |
|---|---|---|
| CA | 1 133 712 | 10/1982 |

(Continued)

*Primary Examiner*—Michael Barr
*Assistant Examiner*—Jason Heckert
(74) *Attorney, Agent, or Firm*—David V. Upite

(57) ABSTRACT

The invention provides a three-dimensional structure having at least one structure surface, the structure being adapted to be attached to an apertured surface with the structure surface facing the apertured surface; and a curved hook element having a base and a distal end, the distal end of the hook element being adapted for insertion into an aperture in the apertured surface, and the base of the curved hook element being slidably affixed to the structure surface of the three-dimensional structure such that movement of the base is constrained along a line within the structure surface. The device can be used in a method of attachment onto an apertured surface, in particular the inner surface of an automatic laundry washing machine drum, and is particularly suitable for dispensing rinse additives into the rinse cycle of an automatic washing machine.

12 Claims, 9 Drawing Sheets

U.S. PATENT DOCUMENTS

| | | | | |
|---|---|---|---|---|
| 5,176,297 | A | 1/1993 | Mooney et al. | |
| 5,356,104 | A * | 10/1994 | Rosenberg et al. | 248/223.41 |
| 5,536,421 | A | 7/1996 | Hartman et al. | |
| 5,687,588 | A | 11/1997 | Azzani et al. | |
| 5,732,853 | A | 3/1998 | Ganzeboom et al. | |
| 5,762,410 | A * | 6/1998 | Lutz | 312/111 |
| 5,792,219 | A | 8/1998 | Hartman et al. | |
| 5,823,019 | A * | 10/1998 | Park | 68/133 |
| 5,832,646 | A * | 11/1998 | Albin et al. | 40/762 |
| 6,138,693 | A | 10/2000 | Matz | |
| 6,179,167 | B1 | 1/2001 | Boot et al. | |
| 6,203,535 | B1 | 3/2001 | Barney et al. | |
| 6,281,183 | B1 | 8/2001 | Harbour | |
| 6,352,158 | B1 | 3/2002 | Cole-Bennett et al. | |
| 6,378,274 | B1 | 4/2002 | Harbour | |
| 6,439,387 | B1 | 8/2002 | Bergman | |
| 6,550,739 | B1 * | 4/2003 | Brindisi | 248/476 |
| 6,571,993 | B2 | 6/2003 | Rodd et al. | |
| 6,581,800 | B2 | 6/2003 | Rodd et al. | |
| 2001/0049846 | A1 | 12/2001 | Guzzi et al. | |
| 2002/0078589 | A1 | 6/2002 | Hagemann et al. | |
| 2002/0088502 | A1 | 7/2002 | Van Rompuy et al. | |
| 2002/0100773 | A1 | 8/2002 | Rodd et al. | |
| 2002/0108969 | A1 * | 8/2002 | Rodd et al. | 222/209 |
| 2003/0172960 | A1 | 9/2003 | Aouad et al. | |
| 2003/0172961 | A1 | 9/2003 | Aouad et al. | |
| 2003/0182732 | A1 | 10/2003 | Davenet et al. | |
| 2004/0088796 | A1 | 5/2004 | Neergaard et al. | |

FOREIGN PATENT DOCUMENTS

| | | | |
|---|---|---|---|
| CA | 11 33 712 | | 10/1982 |
| DE | 39 22 342 | | 1/1991 |
| DE | 39 22 342 | A1 | 1/1991 |
| DE | 39 34 123 | | 4/1991 |
| DE | 39 34 123 | A1 | 4/1991 |
| DE | 101 14 256 | A1 | 3/2001 |
| DE | 199 45 849 | | 3/2001 |
| DE | 19945849 | A1 | 3/2001 |
| EP | 0 215 366 | | 9/1986 |
| EP | 0 351 671 | | 1/1990 |
| EP | 1 195 350 | | 4/2002 |
| WO | WO 94/07979 | | 4/1994 |
| WO | WO 94/07979 | A1 | 4/1994 |
| WO | WO 96/26312 | | 8/1996 |
| WO | WO 97/09480 | | 3/1997 |
| WO | WO 00/02982 | | 1/2000 |
| WO | WO 00/02987 | | 1/2000 |
| WO | WO 00/29537 | | 5/2000 |
| WO | WO 00/49218 | | 8/2000 |
| WO | WO 01/07702 | | 2/2001 |
| WO | WO 01/07702 | A1 | 2/2001 |
| WO | WO 01/07703 | | 2/2001 |
| WO | WO 01/07704 | | 2/2001 |
| WO | WO 01/16271 | | 3/2001 |
| WO | WO 01/23295 | | 4/2001 |
| WO | WO 01/23295 | A2 | 4/2001 |
| WO | WO 01/25526 | | 4/2001 |
| WO | WO 01/25526 | A1 | 4/2001 |
| WO | WO 01/25527 | | 4/2001 |
| WO | WO 01/25527 | A1 | 4/2001 |
| WO | WO 03/069042 | | 8/2003 |
| WO | WO 03/069043 | | 8/2003 |
| WO | WO 2004/044303 | A1 | 5/2004 |

* cited by examiner

ATTACHMENT MEANS

CROSS REFERENCE TO RELATED APPLICATION

This application claims the benefit of U.S. Provision Application No, 60/435,646, filed on Dec. 20, 2002

FIELD OF THE INVENTION

The present invention relates to devices adapted for releasable attachment to an apertured surface such as the inner surface of an automatic fabric washing machine drum. It also relates to methods for attaching such devices to apertured surfaces, and systems and kits comprising such devices. In particular it relates to such devices when also adapted to contain a laundry additive material.

BACKGROUND OF THE INVENTION

There are a great many types of laundry additive materials suitable for use in automatic washing machines for fabric laundering. Cleaning agents such as surfactants and detergent builders are used to assist in the mechanical removal of soil and stains from fabrics being laundered. Bleaching agents, enzymes and adjuvants relating thereto are designed to promote chemical degradation and removal of soils and stains. Fabric conditioners, softeners, anti-wrinkle agents, soil release materials and similar agents serve to alter and enhance the condition, appearance or feel of laundered fabrics. Other auxiliary materials, such as pH adjustment and control agents, buffers, solvents, dispersants, anti-redeposition agents, dye transfer inhibitors, stabilizers, preservatives, perfumes, dyes and the like are used to alter the aqueous environment in the automatic washing machine drum to provide for optimum performance of the active laundry additive materials or to improve the quality or aesthetics of commercialized laundry products containing these active additive materials.

The several types of laundry additive materials described hereinbefore, frequently intermingled or admixed together in a wide variety of combinations for convenience, are commonly marketed to consumers in bulk quantities, in either solid, i.e. granular or tablet, or liquid form.

Consumers carrying out the laundering operation generally add doses or aliquots of this intermingled or admixed product to the automatic washing machine. In the majority of cases a single product is added to the automatic washing machine, for instance directly into the drum or into a dispensing drawer, prior to beginning the automatic washing process.

However, certain laundry additive materials are most effective when introduced to the process at some time after the automatic washing process has begun. For instance, additives intended to enhance the condition, appearance or feel of laundered fabric, such as fabric conditioners, softeners, anti-wrinkle agents, etc., are most effective when added during the rinse cycle, which takes place after the main washing cycle. Indeed, some are ineffective if added prior to the rinse cycle. This can create the need for the consumer to return to the washing machine at some point during the automatic washing process, such as at the beginning of the rinse cycle to add materials which are to function at this later point, e.g. during the rinsing operation.

Therefore various systems have been developed which permit the consumer to place laundry additive material into devices or dispensers at the beginning of the laundering operation with those devices or dispensers serving to add the laundry additives to the washing process automatically at a predetermined later stage of the process. These systems have been particularly concerned with introducing rinse additives into the rinse cycle automatically.

Our co-pending U.S. Provisional Patent Application No. 60/356,544; filed Feb. 13, 2002 defines one system which includes means for introducing a unit dose package containing a laundry rinse additive into an automatic washing machine drum at the beginning of the laundering operation and releasing the contents of the unit dose package into the rinse water during the spin cycle. Our co-pending U.S. Provisional Patent Application No. 60/356,543 filed Feb. 13, 2002 defines a different system which includes a device which can be placed within the washing machine drum containing laundry additive materials so that the additive materials are released into the drum during the spin cycle.

Both of these devices are most effective when attached to the inner surface of the washing machine drum. This necessitates provision of a means for attaching the devices to the inner surface of the drum. Previously developed means for attaching a device to the inside of the drum in an automatic washing machine have been disclosed in DE-A-3934123 and DE-A-3922342.

Automatic washing machine drums are apertured in order to allow entry of water into the drum and these apertures could potentially provide a convenient means for attaching such devices with the use of a hook-based system. However, it is important that any attachment system is secure and does not raise significant risk of the device becoming detached from the inner surface of the drum during the washing process. The drum is moving during a significant proportion of the process and in particular spins rapidly during the spin cycle.

Washing machine drums are provided in a variety of different sizes and the apertures in them also have a variety of different shapes and sizes. The apertures also have varying spacing. It would be desirable to provide an attachment means which does not depend on the shape, size or spacing of the aperture.

Furthermore, two distinct types of washing machine drum are used worldwide. In particular, in North America the models commonly used have a substantially cylindrical drum which is positioned so that the longitudinal axis, about which it rotates, is substantially vertical. Japanese models tend to be similar to North American models. In Europe, in contrast, the drums, whilst also substantially cylindrical, are commonly configured so that their longitudinal axis is substantially horizontal. Thus it would be desirable to provide an attachment means which allows attachment to either of these main types of model.

In addition, it would be desirable to provide a means for allowing the consumer to attach the devices to the inner surface of the washing machine drum in quick and convenient manner.

SUMMARY OF THE INVENTION

According to a first aspect of the invention, there is provided a device adapted for releasable attachment onto an apertured surface. Such a device comprises:

A) a three-dimensional structure having at least one structure surface, the structure being adapted to be attached to an apertured surface with the structure surface facing the apertured surface; and B) a curved hook element having a base and a distal end.

The distal end of the hook element is adapted for insertion into an aperture in the apertured surface. The base of the hook element is slidably affixed to the structure surface of the three-dimensional structure such that movement of the hook base is constrained along a line within the structure surface.

Also provided in a second invention aspect is a method for releasably attaching a device onto an apertured surface. Such a method comprises:

A) providing a device comprising a three-dimensional structure having a structure surface with a curved hook element comprising a distal end and a base which is slidably affixed to the structure surface such that movement of the hook base is constrained along a line within the structure surface;

B) positioning the slidably affixed hook element with its base at a first position on the line in the structure surface along which movement is constrained, with this first position being such that the center of curvature of the hook is beyond the edge of the structure surface;

C) inserting the distal end of the curved hook element into an aperture in the apertured surface while holding the structure surface perpendicular to or at an oblique angle with respect to the apertured surface at the point of attachment;

D) rotating the structure surface into a generally parallel relationship with respect to the apertured surface at the point of attachment such that the hook is engaged in the aperture and constrains movement of the structure surface relative to the apertured surface in a direction perpendicular to these parallel surfaces; and E) moving the structure relative to the apertured surface whilst the distal end of the hook element remains inserted into the aperture, thereby sliding the hook element to a second position on the line within the structure surface along which movement is constrained with this second position being such that the center of curvature of the hook has been moved from a position beyond the edge of the structure surface to a position not beyond this edge.

Preferably, after Step E, with the slidable hook in the second position, there is at least one point of the structure surface other than the hook which is in contact with the apertured surface. In that instance the structure is held against and constrained in relation to the apertured surface through the hook element and at least this one other point of contact.

In a third invention aspect, there is provided a system for releasably attaching a structure device onto an apertured surface which system comprises an apertured surface and a device, the device comprising:

A) a three-dimensional structure having at least one structure surface, the structure being adapted to be attached to the apertured surface with the structure surface facing the apertured surface; and B) a curved hook element having a base and a distal end, the distal end of the curved hook element being suitable for insertion into one of the apertures in the apertured surface, and the base of the curved hook element being slidably affixed to the structure surface such that movement of the base is constrained along a line within the structure surface.

In this system, the hook element is positioned at or near the edge of the structure surface and at an angle with respect to the structure surface such that when the distal end of the hook is inserted into an aperture in the apertured surface, and the structure surface is rotated into a position wherein the two surfaces are substantially parallel, the movement of the structure relative to said apertured surface is constrained by the engaged hook in a direction running substantially perpendicular to the two parallel surfaces.

Further in this system, the base of the hook can be slidably moved, with the hook still engaged in the aperture, from a first position on the line within the structure surface along which movement of the base of the hook is constrained to a second position on that line. This second position is one wherein the center of curvature of the hook is within the edge of the structure surface, which edge the slidable hook had been at or near in its first position. In this second position, the structure is releasably attached to the apertured surface.

The device is particularly suited for use as a carrier for laundry additives of which at least some are to be introduced during the rinse cycle of an automatic laundry washing process.

Therefore in a fourth invention aspect, a method is provided for introducing laundry rinse additive material into the rinse water during the rinse cycle which occurs in a fabric laundering operation carried out in an automatic washing machine containing a drum having an apertured wall, which method comprises:

A) providing a unit dose package containing a laundry rinse additive material;

B) inserting said additive-containing unit dose package into a device according to the first aspect of the invention in which the three-dimensional structure is a rigid housing structure;

C) before beginning operation of the automatic washing machine releasably attaching the device, with said additive-containing unit dose package therein, to the inner surface of the apertured wall of the drum of said automatic washing machine;

D) running said automatic washing machine through its spin cycle to thereby apply centrifugal force to said additive-containing unit dose package within said housing structure, said centrifugal force serving to activate package opening means associated with said package or said housing structure or both, and to thereby open said package, release the contents thereof, and hold said contents within said rigid housing structure; and thereafter E) removing the centrifugal force from said open package by ending the spin cycle during operation of said automatic washing machine; and thereafter F) allowing the laundry additive material within said rigid housing structure to pass by gravitational flow through apertures in said housing structure into the rinse water present in the drum during the rinse cycle in the operation of said automatic washing machine.

In a fifth invention aspect, there is provided a rinse additive dispensing device suitable for releasable attachment to the inner apertured surface of the drum of an automatic washing machine for fabric laundering and suitable for dispensing laundry rinse additive material from a unit dose insert into the rinse water during the rinse cycle which occurs during a fabric laundering operation carried out in a drum-containing automatic washing machine. The dispensing device is a device according to the first aspect of the invention in which:

A) the three-dimensional structure is a housing structure suitable for holding an openable unit dose package containing laundry rinse additive material;

B) the device comprises an opening within said housing structure suitable for permitting insertion into said housing of said openable unit dose package containing said rinse additive material;

C) during the spin cycle of washing machine operation said housing is capable of holding and retaining, by virtue of centrifugal force applied during said spin cycle, the rinse additive material released from said openable unit dose package into said housing during said spin cycle; and D) the device comprises aperture means placed within said housing in such a manner as to permit said released laundry additive material, after cessation of said centrifugal force, to pass by gravitational flow through said aperture means within said housing structure into the rinse water present in said drum during the rinse cycle in the operation of said washing machine.

In a sixth invention aspect, there is provided a method for providing sequential dispensing of laundry additive materials into the several stages of the laundering cycle which occur during the operation of an automatic fabric laundering washing machine containing a drum having an apertured wall. This method comprises:

A) attaching to the inner surface of the apertured wall of the washing machine drum a device according to the first invention aspect in which the three-dimensional structure is a rigid housing structure comprising a base and an openable and closable lid for said base;

B) placing within said housing structure with its lid open at the beginning of the laundering operation, a multi-compartmented insert containing within at least two different compartments thereof at least two different laundry additive materials which are to be added at different times to the contents of the washing machine drum during the laundering cycle;

C) closing the lid of said housing structure with said insert inside to thereby activate means associated with said rigid housing structure to open at least a first compartment of the multi-compartmented insert and to thereby permit dispensing of the material within said opened compartment into said washing machine drum; and D) running said automatic washing machine through its operational cycle, including through its spin cycle to thereby activate means associated with said housing structure and/or with said multi-compartmented insert to open one or more additional compartments of said insert containing laundry additive material different from that in said previously opened first compartment, said opening of said additional compartment occurring after initiation of the spin cycle of said washing machine operation, and said means for opening said additional compartments being activated by the centrifugal force arising from the spin cycle; said opening further permitting the dispensing of the material within said opened compartment(s) into said washing machine drum.

In a seventh invention aspect, a device according to the first aspect of the invention is provided in which the three-dimensional structure is a rigid housing structure suitable for positioning within the drum of an automatic washing machine for fabric laundering and suitable for dispensing laundry additive material into said drum from an insert to be held within said housing structure, which housing structure comprises a base suitable for holding a multi-compartmented insert containing laundry additive materials to be dispensed and an openable and closable lid for said base, said housing structure further comprising means for opening at least one but not all compartments of said multi-compartmented insert when the lid of said structure is closed with said multi-compartmented insert inside said structure.

There is also provided, in an eighth invention aspect, a kit comprising a device according to the first, fifth or seventh aspect of the invention and at least one unit dose package of laundry additive.

In a ninth invention aspect, there is provided a method of washing laundry comprising providing a device according to the first aspect of the invention which is configured so as to be able to contain a dose of laundry additive, inserting a dose of laundry additive into the device, attaching the device to the apertured inner wall of a washing machine drum and running the automatic washing machine through its operational cycle. In this aspect, the dose of laundry additive material may be introduced into the device before or after the device is attached to the apertured wall of the drum.

The device of the invention is configured so that it may be attached without difficulty to the apertured wall of a washing machine drum. In particular, the device allows secure attachment of a three-dimensional structure (such as a structure adapted to hold laundry additive) to the inner wall of a drum using only a single aperture. Thus the precise spacing and arrangement of apertures does not affect use of the device. Further, so long as the hook element can pass through an aperture, the precise size and shape of the apertures is not problematic. Further, the device of the invention is constructed such that it can provide convenient and secure attachment regardless of the orientation of the drum, and in drums of a variety of sizes and shapes.

DETAILED DESCRIPTION OF THE PREFERRED EMBODIMENTS

Figure 1:
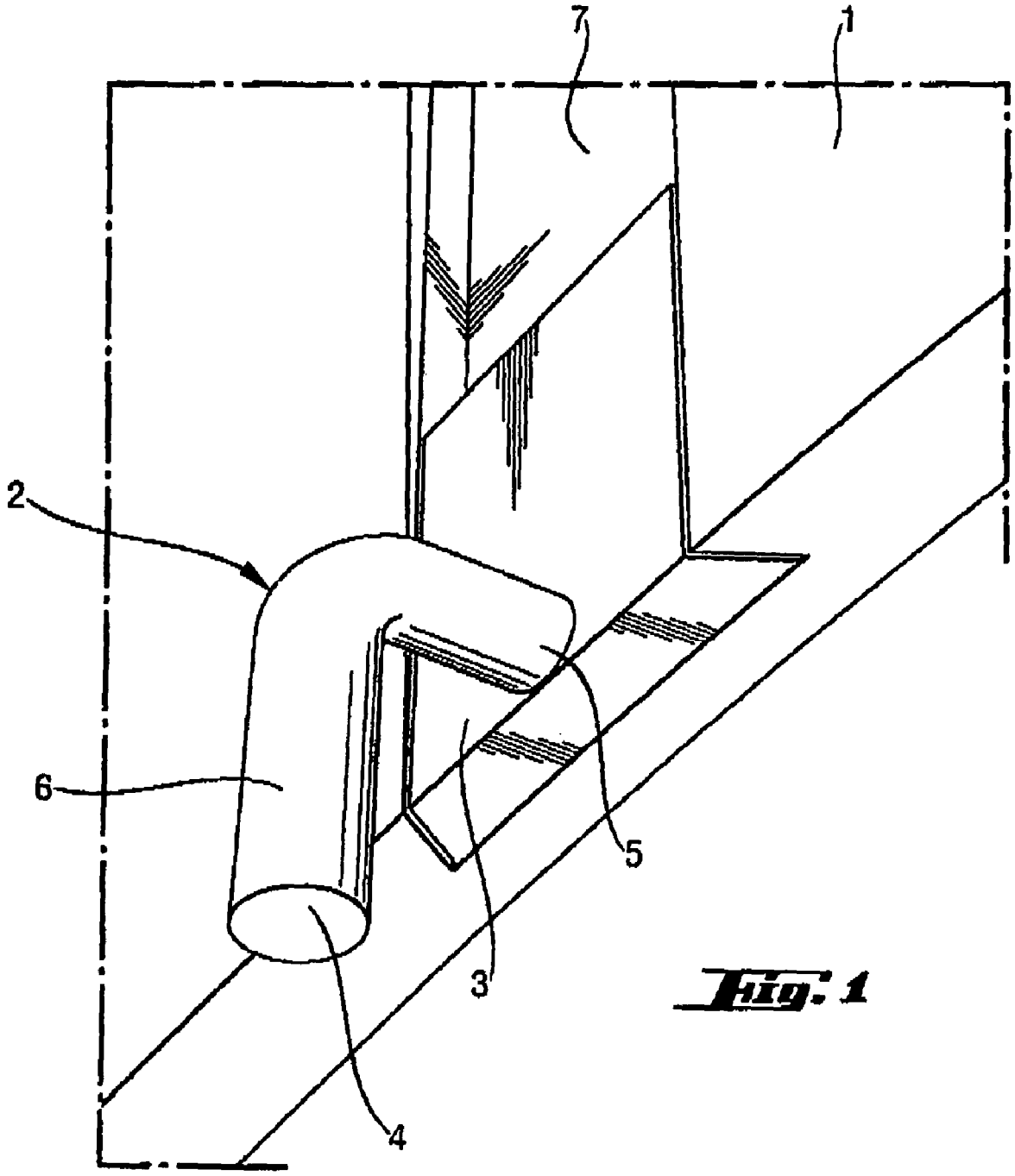
FIG. 1 shows a perspective view of part of the structure surface of one embodiment of a device of the invention.

The device of the invention comprises a three-dimensional structure having a surface which, upon attachment to the apertured surface, will face the apertured surface. This surface is referred to herein as the structure surface.

The three-dimensional structure is preferably configured as a means for containing laundry additive and is particularly preferably a rigid housing. When the three-dimensional structure is a rigid housing the structure surface is commonly referred to as a base plate.

A curved hook element is slidably affixed to the structure surface. The device is releasably attached, ie., held in relationship to the apertured surface by means of the curved hook element.

The structure surface may have any appropriate configuration and is preferably chosen according to the configuration of the apertured surface to which the device is intended to be releasably attached. Since the object of the invention is to provide a device adapted for secure releasable attachment onto a surface, in particular when the apertured surface is one which moves, often at high speed, it is preferred that the structure surface has a configuration chosen so as to mirror the configuration of the apertured surface. If the apertured surface is concave then the structure surface is preferably convex but may be planar. Conversely, if the apertured surface is convex then the structure surface is preferably concave or planar. Since the apertured surface is preferably the inner wall of a washing machine drum, it is preferably concave and the structure surface is thus preferably convex but may be planar.

For instance, if the apertured surface is substantially planar, then the structure surface is preferably substantially planar. The structure surface is often a ruled surface and preferably has the configuration of part of the surface of a cylinder, that is that it is substantially partially cylindrical.

It is generally preferred that if the structure surface has the configuration of a partial cylinder and the apertured surface is concave, then the radius of curvature of the structure surface is generally greater than the radius of curvature of the apertured surface. If the apertured surface is convex and the structure surface takes the form of a partial cylinder then preferably its radius of curvature is smaller than the radius of curvature of the apertured surface.

Substantially planar or substantially cylindrical structure surfaces, and those having other configurations, may be provided with protrusions which act as points of contact with the apertured surface. These protrusions are arranged so as to increase the snugness or secureness of the fit between the apertured surface and the structure surface. In some preferred embodiments the structure surface is formed from a material which is relatively harder and relatively less deformable than the material which forms the protrusions. The protrusions may also be adjustable in position relative to the structure surface. For example, the protrusions might comprise consumer adjustable plastic screw legs. Thus, if the consumer finds that the structure surface is not firmly in place, the consumer can detach the device, unscrew the legs several turns in order to permit the surface to be shimmed up and hence have a snugger fit against the apertured surface.

The structure surface is provided with a curved hook element slidably affixed to the structure surface. In use the distal end of the curved hook element passes into and through an aperture in the apertured surface. For purposes of this invention, the hook element is "curved" if the axis of the hook at its distal end is not at the same angle as is the axis of the hook at its base end. A preferred configuration for the hook element is substantially L-shaped. That is, it is formed from a first element which extends from the base and a second element, perpendicular to the first element, which ends in the distal portion. Preferably the first portion is substantially perpendicular to the structure surface and the second portion is substantially parallel to the direction in the structure surface along which the base of the hook element can move.

The curved hook element can slide along a line of constraint within the structure surface. Generally stop means are provided at each end of the line along which the base of the hook element may be moved to prevent to the hook element moving beyond the ends of this line.

The line of constraint may be, for instance, defined by a channel in which the base of the curved hook element is held. Such a channel can be curved but is preferably substantially straight. Each end of the channel is generally provided with stop means, which prevent the base of the hook element inadvertently exiting the channel.

The line of movement of the base of the hook element is, in a particularly important preferred embodiment, such that it is inclined relative to the structure surface. Preferably the channel has a substantially planar base which is inclined relative to the structure surface in the direction in which movement of the base of the hook element is allowed. Thus for instance at one end of the channel the top surface of the base of the hook element may be substantially coincident with the structure surface whereas at the other end of the channel it is no longer coincident and is effectively deeper into the structure surface. Preferably the angle of incline of the channel is substantially the same along the length of the channel. The angle of incline is the angle between the structure surface at the point of measurement and the base of the channel. Preferably the angle of incline is in the range 0.5 to 10°, more preferably 1 to 8°, particularly preferably 1.5 to 4°. Use of an inclined path for the slidable hook serves to permit and facilitate tight contact of the structure surface with the apertured surface as described in greater detail hereinafter with respect to the method aspects of this invention.

The line along which the curved hook element may move preferably extends to an edge of the structure surface so that the base of the hook element can move from that edge to a point remote from that edge, generally along the defined channel. Preferably it extends only to a single edge.

In the method of the second aspect of the invention a device of the first aspect of the invention is arranged so that the hook element is positioned with its base at a first position along the line along which movement is constrained. This position is preferably at one end of the line along which movement is constrained.

In such a first position, the center of curvature of the curved hook must be beyond the edge of the structure surface. This means that the base end of the hook will generally be positioned initially at or very near the edge of the structure surface.

The distal end of the curved hook element is then inserted into an aperture in the apertured surface with the hook in this first position. Depending upon the configuration of the curved hook element this may require holding the structure surface perpendicular to or at an oblique angle to the apertured surface. If the hook element configuration so permits, then it is in some embodiment possible to insert the distal end of the hook element into an aperture while holding the structure surface at an acute angle with respect to the apertured surface.

The structure surface is then rotated into a generally parallel relationship with respect to the apertured surface at the point of attachment and the hook is manipulated so that the distal portion passes fully through the aperture. At this point, the hook engaged in the aperture. This engagement thus constrains the movement of the structure surface in a direction which is further away from the apertured surface along a line which is perpendicular to the two parallel surfaces.

At this point whilst the distal end of the hook element remains inserted into the aperture, the structure is then moved relative to the apertured surface so that the hook element slides along its line of constraint to a second position. As the slidable hook moves along its line of constraint, with the structure surface still held at parallel to the apertured surface, the center of curvature of the curved hook passes from a point which is beyond the edge of the structure surface, the hook cannot be disengaged from the aperture by re-rotating the structure surface. This is because when the surface starts to rotate back through the arc it travelled when the hook was first inserted and the surfaces brought into parallel relationship, the edge of the structure surface at that point will now contact the apertured surface. This prevents the further rotation of the structure surface, which rotation would otherwise disengage the hook from the aperture. At this point, the structure surface is securely attached to the apertured surface and cannot be moved away from the apertured surface.

The structure surface remains attached via the hook to the apertured surface in this manner so long as the slidable hook remains it its "interior" position, ie., in a position wherein the center of hook curvature does not extend beyond the edge of the structure surface. The slidable hook can be kept in this "interior" position by a number of means. For example, the slidable hook arrangement may be configured so that the simple friction within the hook's sliding path will keep the hook from sliding back toward the edge of the structure surface. Further, in configurations wherein the method of this invention is used to attach a device to vertical apertured surface, such as the inside surface of the apertured drum in a top-loading washing machine, the hook may be kept in its interior position by gravity which holds the device with the hook in this position.

The most preferred means for keeping the slidable hook in its interior position so as to keep the structure surface (and associated device) attached to the apertured surface is to have the structure surface snugly, tightly and securely positioned against the apertured surface. Generally, this occurs by having at least one edge or other part, eg., protrusions, of the structure surface contact, and preferably tightly contact, the apertured surface when the hook has been moved to its interior position.

In the usual situation after some movement of the slidable hook, at least one other point on the structure surface will generally come into contact with the apertured surface in addition to the hook element. Preferably it will be an edge of the structure surface but could also be one or more protrusions. Preferably the structure surface contacts the apertured surface at at least three points other than the hook element. Movement of the slidable hook is generally continued until contact of the structure surface with the apertured surface is sufficient to induce the constrainment of further movement of the structure relative to the apertured surface even when moving force is removed and even when the apertured surface itself moves, for instance later in the washing process.

Another means for bringing about tight contact of the structure surface with the apertured surface is to utilize an assembly wherein the path of the slidable hook is inclined away from the structured surface as hereinbefore described. When the hook path is inclined, ie., gets further away from the structure surface as the hook travels away from the edge of the structure surface, the sliding of the hook serves to move the structure surface closer to the apertured surface. When part of the structure surface is or becomes in contact with the apertured surface, this movement of the two surfaces toward each other tends to tighten the contact between the two surfaces. This in turn provides a snug fit of the two surfaces together and hence a snug fit of the device to the apertured surface.

As can be seen from the discussion above, the centre of curvature of the curved hook is such that it is beyond the edge of the structure surface at the beginning of the method and is capable of being moved into a position where it is not beyond that edge. It is this movement which prevents release of the device from the apertured surface. Thus it is not always necessary to be able to determine the exact position of the centre of curvature of the curved hook in every instance, since the ability to undergo the method discussed above is paramount. However, if the curved hook has substantially the shape of an arc of a circle then the centre of curvature is the centre of that circle. Similarly, if the curved hook element is substantially L-shaped then the centre of curvature can be defined as the centre of a circle to which both sections of the hook are tangents.

In this method, the hook element is positioned at a first position and, after insertion of the distal portion of the hook element into the aperture, moved to a second position. This direction is defined herein as the movement direction. The direction in which the second element of a substantially L-shaped hook element extends from the first portion is preferably opposite the movement direction.

In preferred embodiments the apertured surface is the inner wall of an automatic washing machine drum and the base of the hook element is constrained so that it can move only along a substantially straight line which, in application of the method, is substantially parallel to the axis of the drum. That is, if the drum has a vertical axis then the device is positioned so that the line along which the base of the hook element may move is substantially vertical. If the drum has a substantially horizontal axis then in application of the method the device is positioned such that the line along which the hook element base may move is substantially horizontal.

Preferably the device is configured so as to contain laundry additive. It can be used to contain additive that is to be released at the beginning of an automatic washing cycle, but is of particular benefit when adapted to contain an additive to be dispensed at a later stage in the washing cycle, in particular a rinse additive.

Accordingly, in the fourth aspect of the invention laundry rinse additive material is introduced into the rinse water during the rinse cycle. This method comprises providing a unit dose package containing a laundry rinse additive material and inserting this package into a device of the invention in which the three-dimensional structure is a rigid housing structure. Before beginning operation of the automatic washing process the device is releasably attached to the inner surface of the apertured wall of the drum of the automatic washing. Attachment of the device to the inner surface of the wall is preferably carried out after insertion of the unit dose package into the rigid housing structure in this aspect of the invention, but it can also be attached prior to insertion of the unit dose package.

The automatic washing process is then run, including the spin cycle. This spin cycle applies centrifugal force to said additive-containing unit dose package. This serves to activate package opening means associated with the package or the housing structure or both, to thereby open the package and release the contents into the rigid housing structure. The contents are held in the rigid housing structure until the centrifugal force is removed by ending the spin cycle. The laundry additive material then passed by gravitational flow through apertures provided in the housing structure into the rinse water, due to the fact that the device has been attached inside the drum, which brings it into significant contact with rinse water during the laundering operation.

According to the fifth aspect of the invention the device of the invention is a rinse additive dispensing device in which the three-dimensional structure is a housing structure suitable for holding an openable unit dose package containing laundry rinse additive material. The housing structure accordingly comprises an opening suitable for permitting insertion into the housing of the unit dose package. The housing is constructed so as to hold and retain, during the spin cycle by virtue of centrifugal force applied during the spin cycle, the rinse additive released from the unit dose package during the spin cycle. The device is also constructed so as to comprise aperture means such as holes, within the housing, which permit laundry additive material to pass by gravitational flow through the aperture means are cessation of the centrifugal force into the rinse water.

Processes and devices of these types are described in more detail in our co-pending U.S. Provisional Application Serial No. 60/356,544 filed 13 Feb. 2002, the contents of which are incorporated herein by reference.

The invention is also useful in methods which provide sequential dispensing of laundry additive materials into at least two stages of the laundering cycle.

Accordingly, in the sixth aspect of the invention the device is also configured so that the three-dimensional structure is a rigid housing structure comprising a base and an openable and closable lid for the base. The method comprises placing a multi-compartmented insert in the housing structure when the housing structure has its lid open. The insert contains at least two different compartments containing at least two different laundry additive materials in separate compartments. These different materials are to be added at different times to the laundering cycle.

When the lid of the housing structure is closed with the insert inside, means associated with the rigid housing structure are activated to open a first compartment of the multi-compartmented insert, permitting dispensing of the material within that compartment into the housing structure and, when the laundering operation begins, into the washing machine drum, generally by flow of washing liquor through the housing structure.

In this aspect of the invention it is preferred that the device is attached to the wall of the drum prior to placing the insert within the housing structure. However, it is also possible to place the insert within the housing structure before attaching it to the drum. In this case closing the lid of the housing structure may be carried out either before or after attachment of the device to the wall of the drum, but is preferably carried out after such attachment.

During the operational cycle of the automatic washing machine the spin cycle activates means associated with the housing structure and/or with the multi-compartmented insert to open at least one additional compartment containing a different laundry additive. Opening of this additional compartment occurs after initiation of the spin cycle due to the means for opening the additional compartment being activated by the centrifugal force arising from the spin cycle. This permits dispensing of the additional different laundry additive material into the housing structure and then into the washing machine drum.

The device of the invention can also be configured to be particularly suitable for use in this particular method and therefore in a preferred seventh aspect of the invention the three-dimensional structure is a rigid housing structure suitable for positioning within the drum of an automatic washing machine and dispensing laundry additive material into the drum from an insert held within the housing structure. The housing structure comprises a base which holds the insert and an openable and closable lid. The structure also comprises means for opening at least one but not all compartments of the insert when the lid is closed with the insert inside the housing structure.

Details of preferred devices and methods of this type are disclosed in our co-pending U.S. Provisional Application Serial No. 60/356,543 filed 13 Feb. 2002, the disclosure of which is incorporated herein by reference.

As discussed above, the devices of the invention are particularly suitable for attachment to the inner wall of a laundry washing machine drum. Consequently they can be used in an automatic washing process to introduce laundry additive material into the process.

Particularly preferably they can be supplied to the consumer in the form of a kit which comprises the device and at least one unit dose package of laundry additive. Preferably the kit comprises at least two, more preferably at least five, and in some preferred embodiments at least 10, unit dose packages of laundry additive.

A single device can be designed so as to fit a variety of drums having different sizes. In particular, it is generally designed to have dimensions such that it fits the smallest drum intended for use and can then be effective in larger drums.

Specific embodiments of the invention are shown in the Figures.

FIG. 1 shows part of the structure surface 1 of a device of the invention. It can be seen that the base 3 of a hook element 2 is held within a channel 7 along which the base of the hook element can slide.

Figure 2:
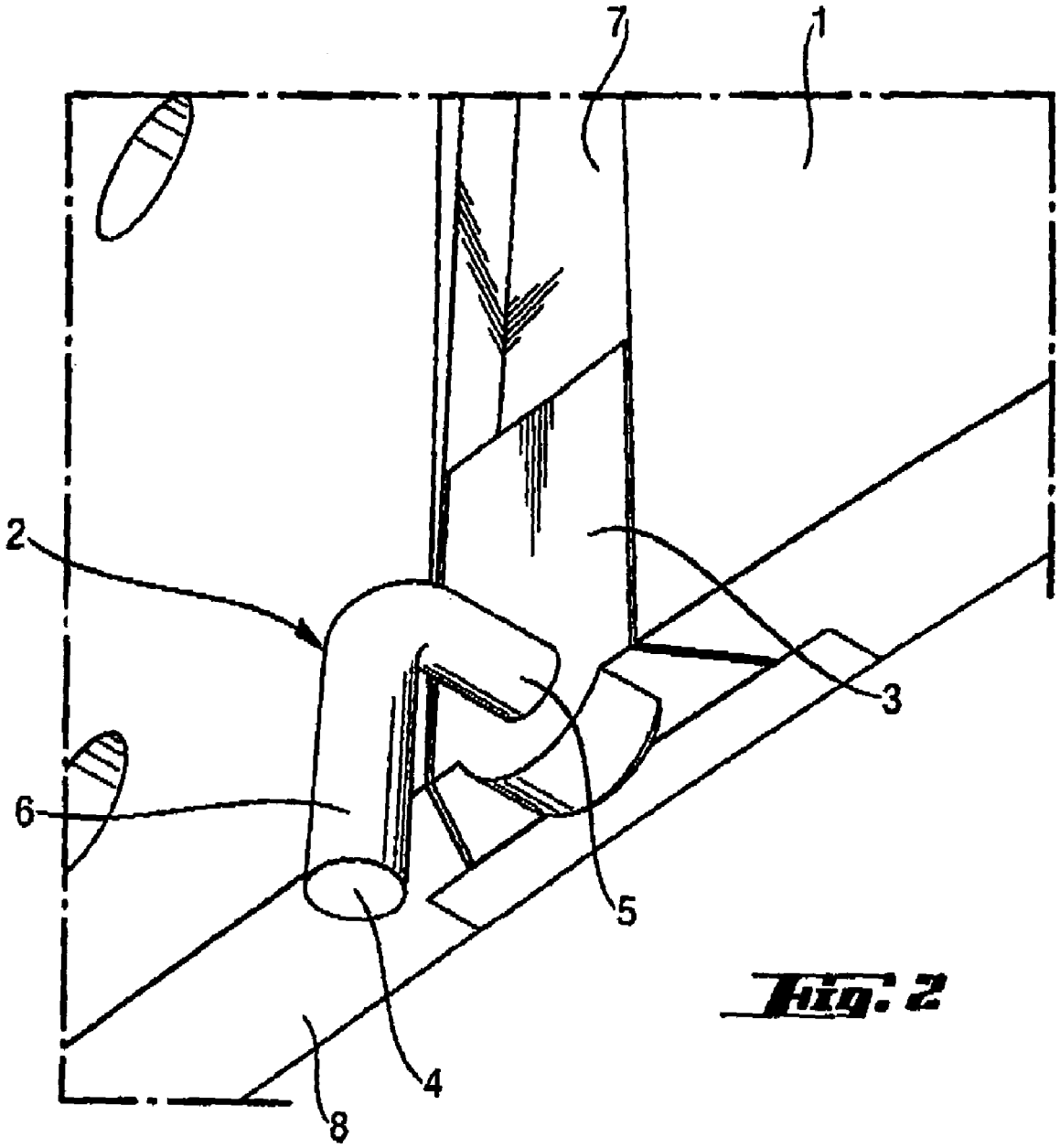
FIG. 2 shows a perspective view of part of the structure surface of an alternative embodiment of a device of the inventions.

An alternative embodiment is shown in FIG. 2 in which the base 3 is of different shape and aesthetic design configuration.

Hook element 2 is of substantially right-angled configuration having a first element 5 attached to the base 3 and a second element 6 which ends in the distal portion 4. The hook element is configured so as to be capable of passing through apertures in the wall of a washing machine drum.

Figure 3:
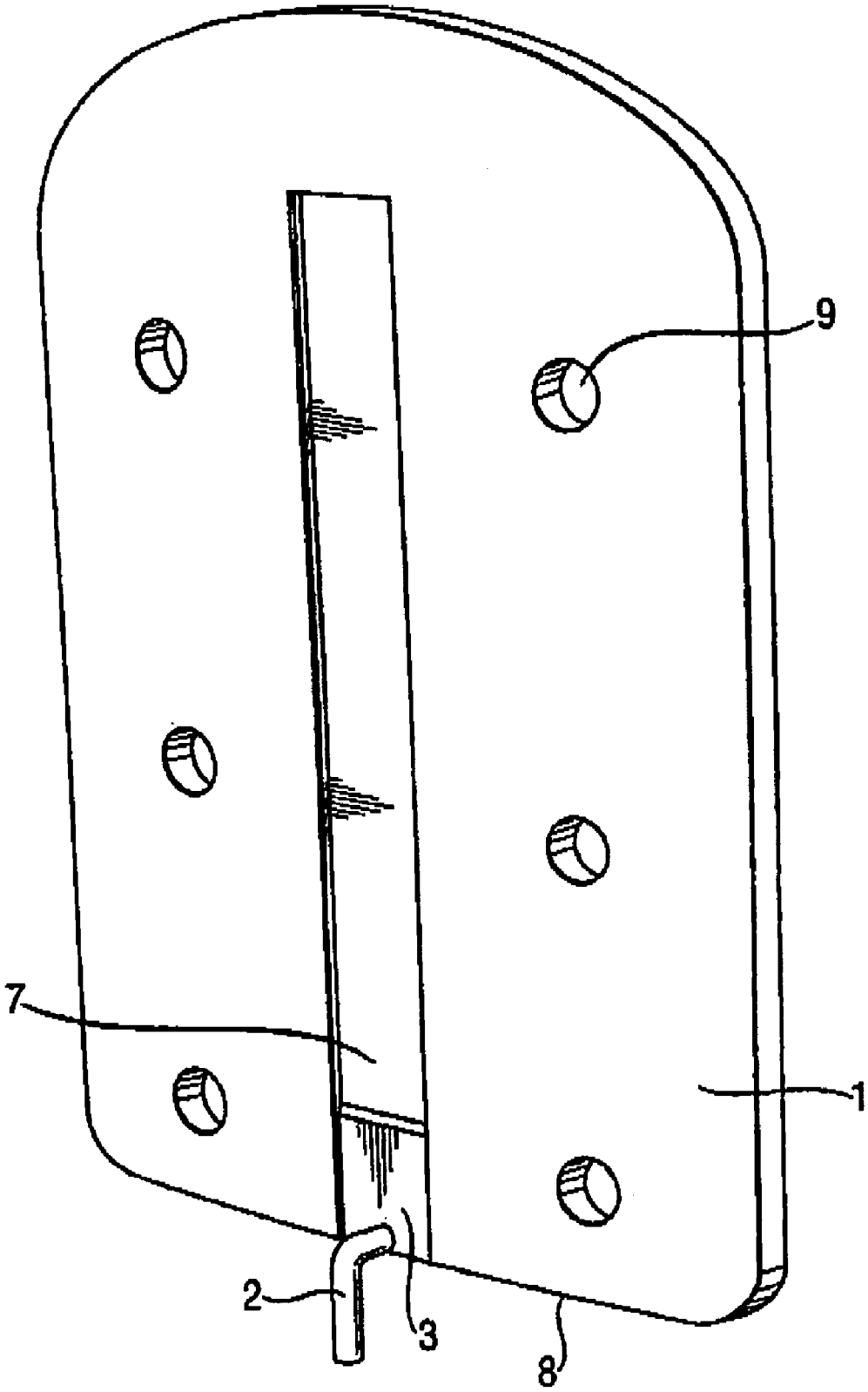
FIG. 3 shows a perspective view of the structure surface of the device base plate of FIG. 1.

FIG. 3 shows the entire structure surface 1 of a device of the invention. It can be seen that the channel 7 extends from one edge 8 to a position further remote from that edge. It only extends to one of the edges. It is substantially straight. Therefore the path along which the base of the hook element is constrained to move is also substantially straight. The structure surface contains holes 9 which can be decorative or non-functional or which can be used to attach the structure surface to a device.

Figure 6:
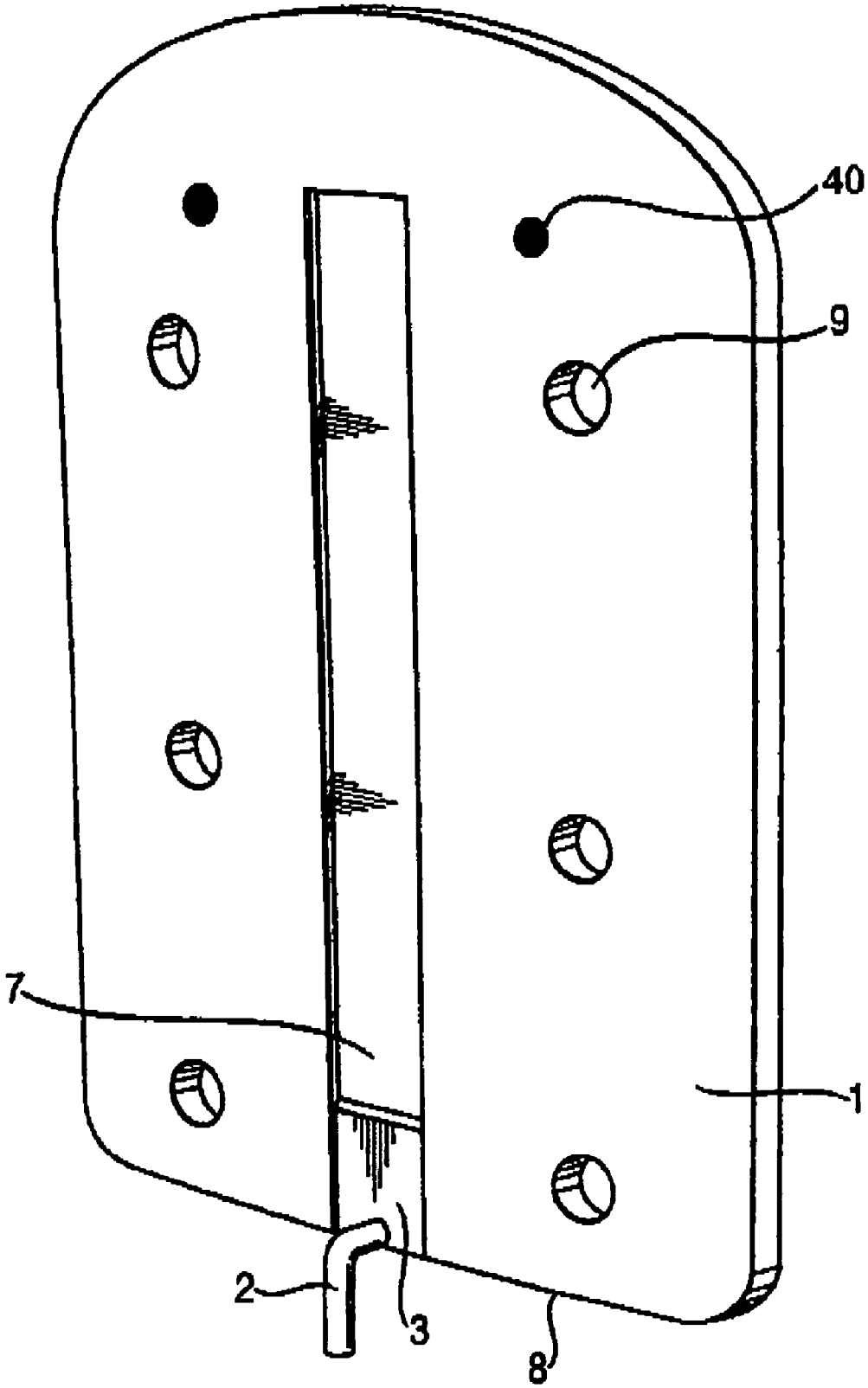
FIG. 6 shows a perspective view of an alternate structure of the device base plate.

FIG. 6 illustrates the features of FIG. 1 along with the optional protrusions 40.

FIG. 4 shows transparent side views of a device of the invention when configured so as to be suitable for dispensing laundry additive material, provided in an insert, into an automatic washing machine drum.

The structure surface is part of a three-dimensional structure which is a housing structure 10. The structure surface is the surface of a base plate 1 which, together with a side wall structure 22, forms the base of the housing structure. The side wall structure 22 is affixed to the base plate 1. A lid 16 for the housing structure 10 is attached to the side wall structure 22 at hinge 14.

Figure 4A:
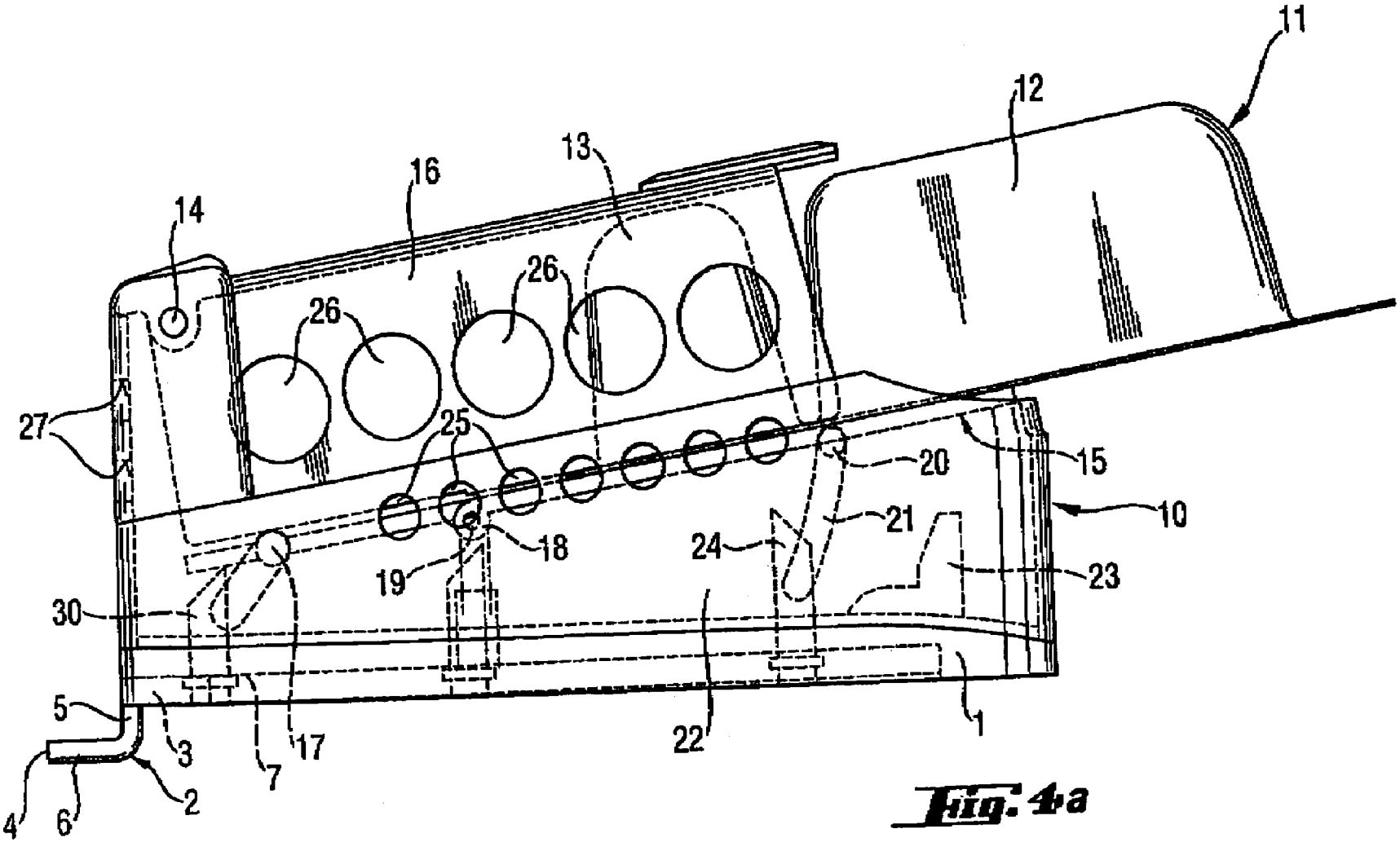
FIG. 4 shows transparent side views of a device of the invention which is suitable for containing and dispensing two different laundry additives in a laundry washing cycle.
Figure 4B:
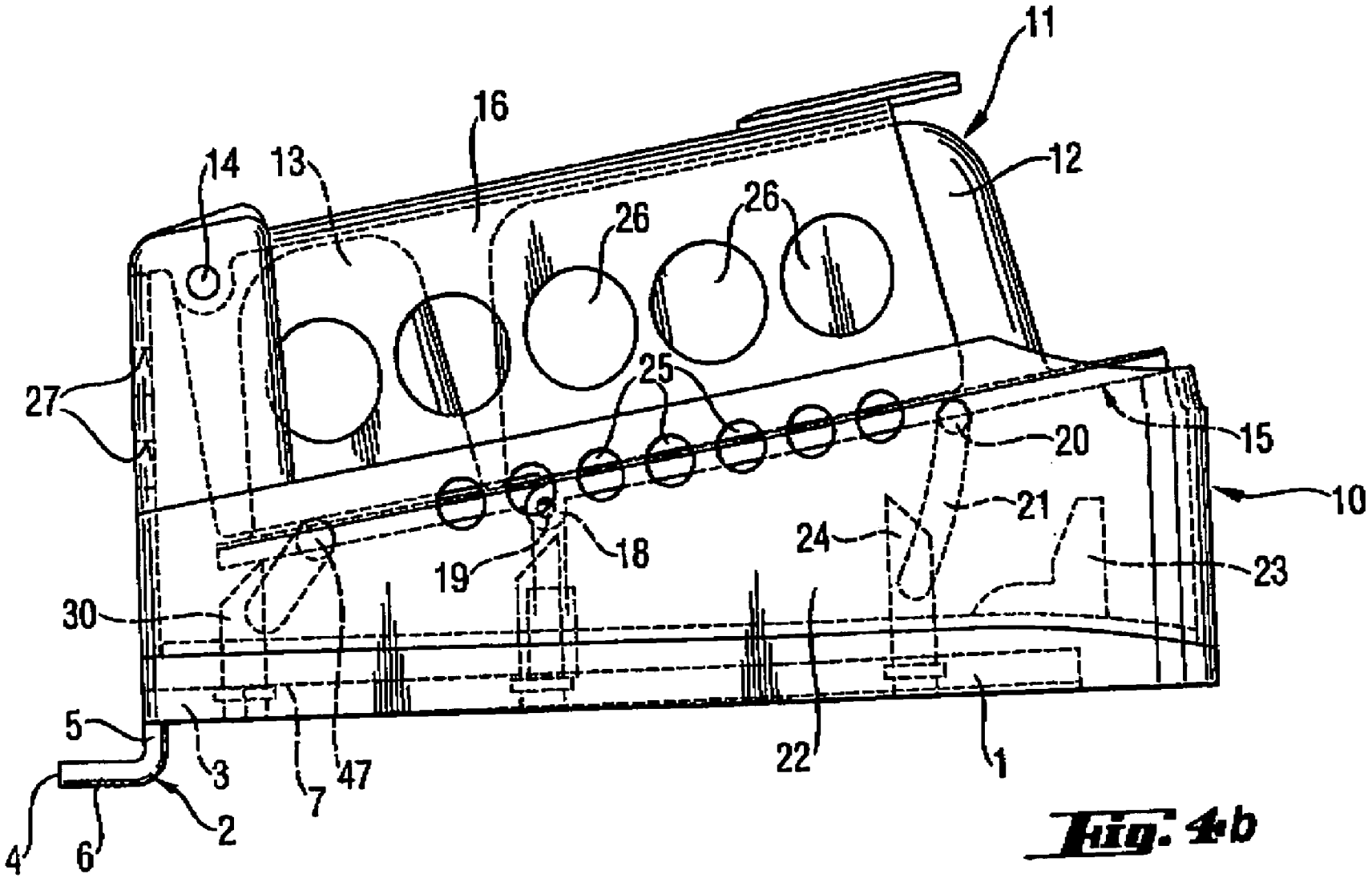
Figure 4C:
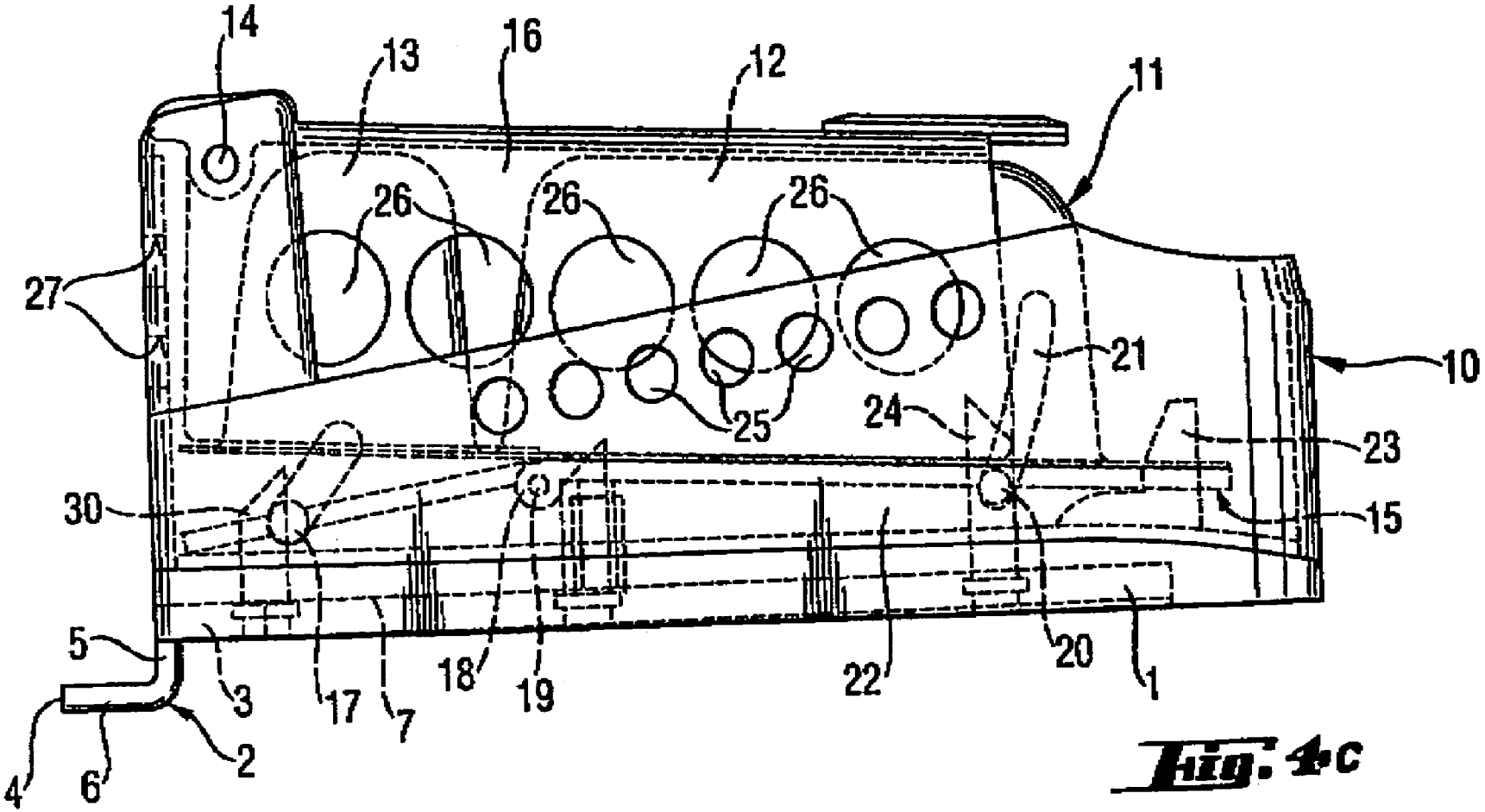

FIG. 4A shows the housing structure 10 in an open position with insert 11 partially inserted. FIG. 4B shows the housing structure 10 still in an open position but with the insert 11 completely inserted therein. FIG. 4C shows the housing structure 10, with the insert 11 inside, in a completely closed position. The insert 11 comprises wash additive compartment 12 and rinse additive compartment 13. The insert 11 is inserted into the housing structure 10 with the rinse additive compartment 13 positioned toward the hinge 14 of the housing structure lid 16.

The housing structure 10 also comprises a hinged positioning plate 15. This is affixed to the housing lid 16 by means of attachment means 17. It also rests on a compressable pivot point means 18. The positioning plate 15 is hinged at hinge point 19. The positioning plate 15 also has lugs 20 at the wash additive end opposite the attachment means 17. These lugs 20 fit into guide grooves 21 in each of the opposing walls of the side wall structure 22.

When the lid 16 is closed, this activates rotation of the hinged positioning plate 15 around its hinge point 19 and at the same time depresses the compressible pivot point means 18. The wash additive end of the hinged positioning plate 15 thereby rotates towards the base plate 1 and is kept in the closed position by means of a latch mechanism 23 associated with the base plate 1.

Thus, as the lid 16 is closed, the rotation of the wash additive end of the hinged positioning plate 15 is guided by the lugs 20 in the grooves 21 in the manner of a cam arrangement as the structure is placed in the closed latch position. The wash additive compartment 12 thus impinges upon sharpened, cylindrical wash additive puncturing means 24 associated with base plate 1. This action punctures the wash additive compartment 12 and releases the wash additive content into the housing structure 10. This also positions the rinse additive compartment 13 above, but not in contact with, sharpened cylindrical rinse additive puncturing means 30, also associated with base plate 1.

Later in the laundering operation, during the spin cycle, the centrifugal force generated by the spin cycle causes the rinse additive compartment 13 of the insert 11 to rotate towards the base plate 1. This action then causes the rinse additive compartment 13 to impinge upon additional rinse additive compartment puncturing means 30. The contents of the rinse additive compartment are thus released into the housing structure 10. The housing side wall structure 22 contains holes 25 through which released contents of the insert compartments can flow into the washing machine drum. Likewise, the lid 16 contains holes 26 for the same purpose.

Rinse additive released by spin cycle centrifugal force is held in the bottom of the housing structure 10 until the spin cycle stops. This released rinse additive can then flow by gravity through holes 27 at the lid hinge end of the housing structure 10 and into the washing machine drum.

Before the device is closed and latched it is releasably attached to the inside of the washing machine drum by means of the hook element 2. The outer surface of the base plate 1 is, as illustrated in FIG. 3, provided with substantially straight channel 7. This channel has a base which is inclined relative to the surface of the base plate such that it is deeper at the end remote from the edge 8 than at the edge 8. The base of the channel 7 is substantially planar such that the angle between the base and the surface of the base plate is constant along the length of the channel. This angle is approximately 4°. Thus as the base 3 of the hook element 2 slides along the channel 7 it moves deeper into the base plate 1. Consequently, the point of joining of the first and second elements of the hook element moves closer to the base plate surface.

Figure 5A:
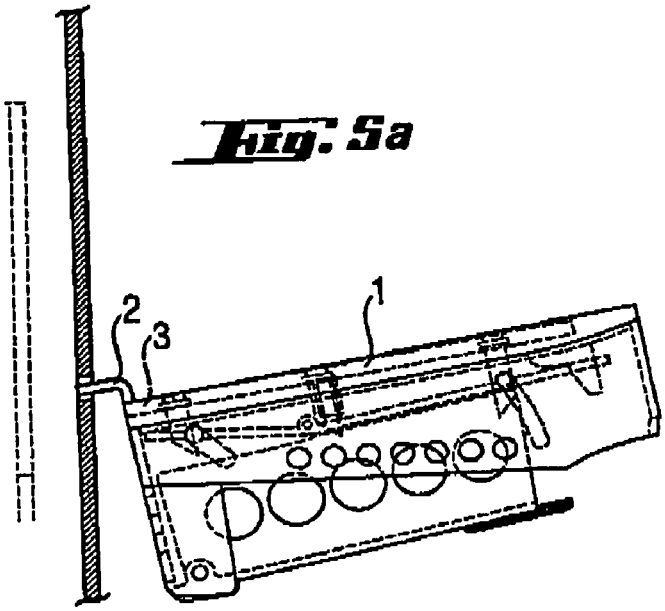
FIG. 5 shows a transparent side view of the method of attachment of a FIG. 4 dispensing device to the inside wall of the drum of a top-loading, vertical-drum automatic washing machine.
Figure 5C:
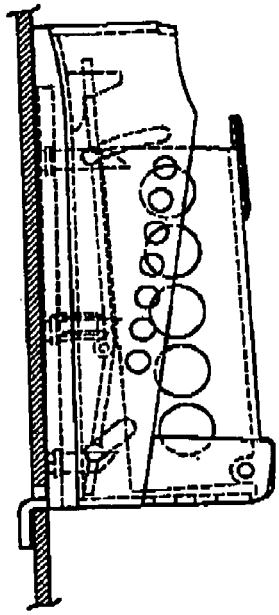
Figure 5B:
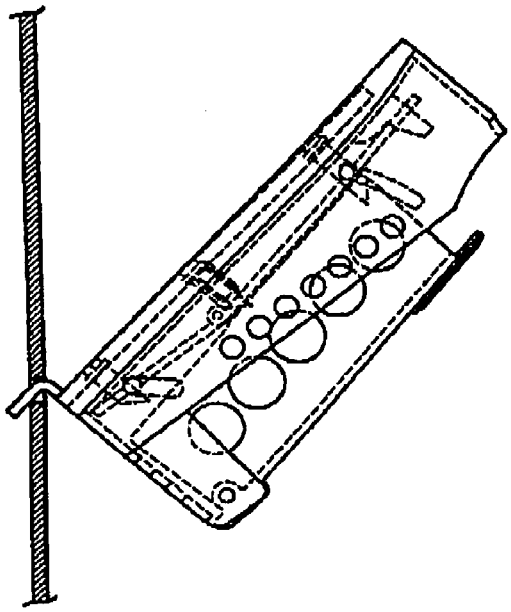
Figure 5D:
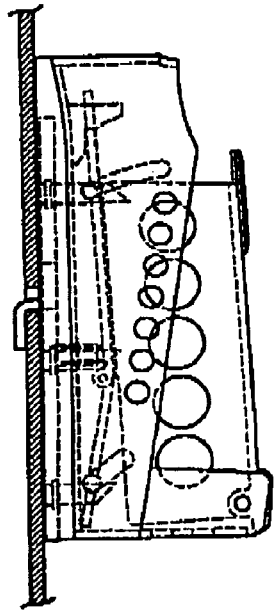
Figure 5E:
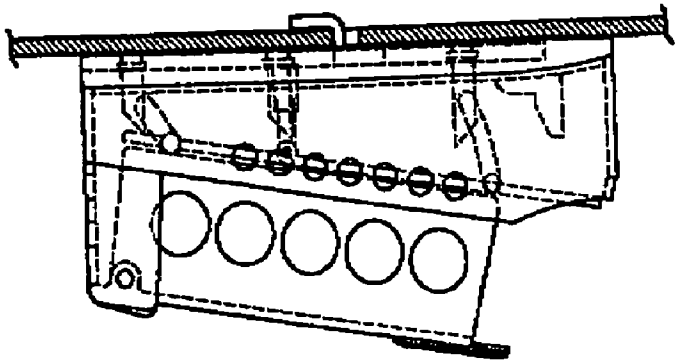
Figure 5F:
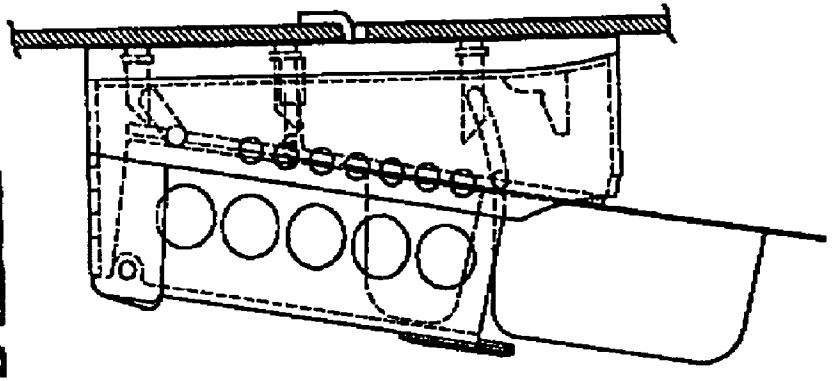
Figure 5G:
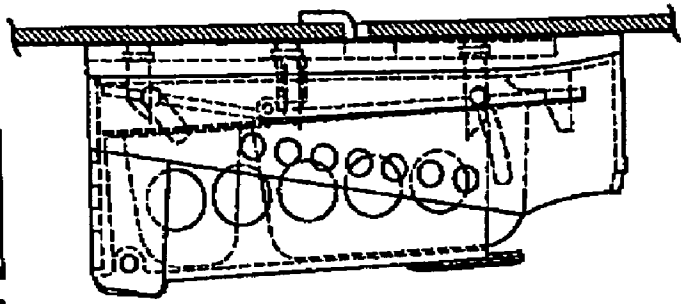

Attachment of a device to the inside wall of a washing machine drum and use of the device to receive a laundry additive insert are illustrated in FIGS. 5*a* through 5*g*. FIG. 5 shows a series of illustrations of the steps involved in inserting a device of the invention into an apertured surface. As can be seen in FIG. 5*a*, the device, having a curved hook 2 which is substantially L-shaped, is held so that the structure surface 1 of the device is at an oblique angle to the apertured surface (in this case the wall of an automatic washing machine drum). The curved hook 2 is positioned so that its base 3, which is constrained to move along a channel in the structure surface 1, is at the edge of the structure surface. Thus its center of curvature is beyond the edge of the structure surface. The distal end of the hook is inserted through the aperture and, as can be seen in FIG. 5*b*, the structure surface is then rotated until, as shown in FIG. 5*c*, it is now parallel to the apertured surface. As shown in FIG. 5*d*, the device is now moved so that the base 3 of the curved hook 2 is allowed to slide along the channel so that the center of curvature of the curved hook 2 is now no longer beyond the edge of the structure surface and it is not possible to rotate the device so that the hook can be removed from the aperture. FIG. 5*e* to 5*g* show opening of the device, insertion of a cartridge containing rinse additive and closing of the device.

What is claimed is:

1. A device adapted for releasable attachment onto an apertured surface of a drum located within a laundry washing machine, said device comprising:

A) a three-dimensional structure having at least one structure surface, the structure being adapted to be attached to the apertured surface of the drum with the structure surface facing the apertured surface; and B) a curved hook element having a base and a distal end, the distal end of the hook element being adapted for insertion into an aperture in the apertured surface, and the base of the curved hook element being slidably affixed to the structure surface of the three-dimensional structure such that movement of the base is constrained along a line within the structure surface;

wherein the hook is of substantially right-angled configuration having first and second perpendicular elements wherein the first element is attached to the distal end of the hook element and is substantially perpendicular to the structure surface at the point of contact of the base of the hook with the structure surface;

wherein the base of the hook element is constrained in a substantially straight channel provided in the structure surface, wherein the channel has a base which is inclined relative to the structure surface in the direction in which movement of the base of the hook element is allowed thereby defining an angle of incline, and wherein the hook element moves in a substantially vertical direction, and wherein the hook element slides along an inclined path at said angle of incline;

wherein the line along which the movement of the base of the hook element is constrained extends from only one edge of the structure surface to a position remote from that edge;

wherein the structure surface is provided with at least one, protrusion adapted to contact the apertured surface after attachment of the device to the surface;

wherein said structure surface protrusion(s) is/are formed from a material which is relatively more elastically deformable than is the rest of the material of said structure surface D) a rigid housing structure comprising a base and an openable and closable lid for the base capable of receiving a fabric care product.

2. The device of claim 1, when the rigid housing structure further comprises a multi-compartmented insert.

3. The device of claim 1, wherein the angle of include is from 0.5° to 10°.

4. The device of claim 3, wherein the angle of incline is 1° to 8°.

5. The device of claim 4, wherein the angle of include is 1.4° to 4°.

6. The device of claim 2, wherein the angle of include is 1.4° to 4°.

7. The device of claim 4, wherein the rigid housing structure further comprises a hinged plate that is affixed to said lid by an attachment means.

8. The device of claim 7, wherein the hinged plate is capable of resting on a compressable pivot point means.

9. The device of claim 8, wherein the positioning plate is hinged at a hinge point.

10. The device of claim 9, wherein the position plate comprises a lug.

11. The device of claim 10, wherein said lug is at the end opposite side of said attachment means.

12. The device of claim 11, wherein the rigid housing structure further comprises a plurality of holes where fabric care product is capable of flowing from the device into a laundry washing machine.

* * * * *